US006811046B2

(12) United States Patent
Stein

(10) Patent No.: US 6,811,046 B2
(45) Date of Patent: Nov. 2, 2004

(54) DISPLAY RACK WITH MULTIPLE BOARD SIZE

(76) Inventor: Allen R. Stein, 6126 Weatherly Dr., Atlanta, GA (US) 30328

( * ) Notice: Subject to any disclaimer, the term of this patent is extended or adjusted under 35 U.S.C. 154(b) by 0 days.

(21) Appl. No.: 10/072,032

(22) Filed: Feb. 7, 2002

(65) Prior Publication Data

US 2003/0047528 A1 Mar. 13, 2003

Related U.S. Application Data

(60) Provisional application No. 60/318,422, filed on Sep. 10, 2001.

(51) Int. Cl.[7] ..... A47F 5/12

(52) U.S. Cl. ..... 211/169; 211/10; 211/50; 211/45; 211/55

(58) Field of Search ..... 211/184, 168, 211/169, 10, 11, 45, 47, 49.1, 50, 52, 53, 55; 206/740, 311; 248/444.1, 450, 447.1, 447, 447.2; 40/341, 375, 376, 380, 381; D6/409

(56) References Cited

U.S. PATENT DOCUMENTS

| | | | | | |
|---|---|---|---|---|---|
| 238,117 | A | * | 2/1881 | Hillman | 211/45 |
| 322,758 | A | * | 7/1885 | Smead | 211/50 |
| 356,520 | A | * | 1/1887 | Adams | 211/169 |
| 679,549 | A | * | 7/1901 | Breeding | 40/376 |
| 823,559 | A | * | 6/1906 | Stone | 40/339 |
| 943,821 | A | * | 12/1909 | Feldman, Jr. | 211/96 |
| 2,216,633 | A | * | 10/1940 | Steinberg et al. | 283/66.2 |
| 2,304,918 | A | * | 12/1942 | Hofrichter | 281/40 |
| D173,363 | S | * | 11/1954 | Louis | D19/64 |
| 2,876,907 | A | * | 3/1959 | Amberg | 211/11 |
| 3,235,093 | A | | 2/1966 | Eisbart et al. | |
| 3,568,852 | A | * | 3/1971 | Howard | 211/113 |
| 3,583,570 | A | | 6/1971 | Black | |
| 3,965,583 | A | | 6/1976 | Price | |
| 4,128,176 | A | | 12/1978 | Green | |
| 4,232,791 | A | * | 11/1980 | Howard | 211/47 |
| 4,331,245 | A | * | 5/1982 | Schell | 211/45 |
| 4,331,425 | A | * | 5/1982 | Davis, Jr. | 434/252 |
| 4,438,852 | A | * | 3/1984 | Evans | 211/11 |
| 4,542,827 | A | | 9/1985 | Pilzer | |
| 4,666,157 | A | * | 5/1987 | Bodine et al. | 473/407 |
| 4,682,697 | A | | 7/1987 | Cohen | |
| 4,703,943 | A | * | 11/1987 | Zelenko et al. | 206/472 |
| 4,827,641 | A | * | 5/1989 | Mori | 40/376 |
| D304,397 | S | * | 11/1989 | Wright et al. | D6/454 |
| 5,027,956 | A | | 7/1991 | Lotufo | |
| 5,056,248 | A | | 10/1991 | Blanchard | |
| 5,078,670 | A | | 1/1992 | Volkert | |
| 5,111,626 | A | | 5/1992 | Fortune | |
| 5,133,665 | A | * | 7/1992 | Engel et al. | 434/167 |
| 5,181,901 | A | | 1/1993 | Volkert | |
| D335,781 | S | * | 5/1993 | Moncrief et al. | D6/409 |
| 5,280,840 | A | * | 1/1994 | Terpening | 211/165 |
| 5,346,455 | A | | 9/1994 | Volkert | |
| 5,452,809 | A | * | 9/1995 | Capel | 211/47 |
| 5,503,278 | A | * | 4/1996 | Ishmael | 211/169 |
| 5,557,039 | A | | 9/1996 | Annis et al. | |
| 5,582,888 | A | | 12/1996 | Volkert | |
| 5,782,366 | A | * | 7/1998 | Garza, Jr. | 211/41.12 |
| 6,000,561 | A | * | 12/1999 | Schumacher | 211/165 |
| 6,068,903 | A | | 5/2000 | Volkert | |
| D436,137 | S | * | 1/2001 | Grant et al. | D20/41 |
| 6,224,106 | B1 | * | 5/2001 | Murphy | 281/15.1 |
| 6,237,782 | B1 | * | 5/2001 | Hunn | 211/47 |

FOREIGN PATENT DOCUMENTS

| | | | |
|---|---|---|---|
| JP | 8/267955 | * | 7/1995 |

* cited by examiner

*Primary Examiner*—Carl D. Friedman
*Assistant Examiner*—Jennifer E. Novosad
(74) *Attorney, Agent, or Firm*—Gardner Groff, P.C.

(57) ABSTRACT

A display device including a plurality of display panels, at least one of the panels having a dimension differing in at least one aspect from a corresponding dimension of another panel. The invention also includes sets of display panels for use with such a display device, and related display methods.

2 Claims, 4 Drawing Sheets

DISPLAY RACK WITH MULTIPLE BOARD SIZE

CROSS-REFERENCE TO RELATED APPLICATION

This application claims the benefit of U.S. Provisional Patent Application Ser. No. 60/318,422, filed Sep. 10, 2001, which is hereby incorporated herein by reference in its entirety for all purposes.

FIELD OF THE INVENTION

The present invention relates generally to methods and devices for displaying products, materials and/or information; and relates more particularly to a display system utilizing display boards or pallet cards of multiple and differing size and/or shape, and to associated display methods, for improving the display presentation of floor covering products or other materials.

BACKGROUND OF THE INVENTION

Currently, many types of materials and information such as carpet, wood flooring, laminate, vinyl, ceramic, rugs and other floor covering products, wall-paper, paneling and paint, as well as associated marketing information, pricing, etc., are displayed on loose samples or on page or board-type displays referred to as pallet card displays or rack and board displays. Each pallet card typically displays one or more samples of a floor covering product or other material and/or information on one or both of its sides. The cards can be made of, for example, card stock, wrapped card stock, hardboard, styrene, formed or molded plastic products, wood, metal, or other material(s). One or more such pallet cards are typically attached to a display fixture or rack of some type, including but not limited to floor-standing or wall-mounted support devices using a short pin-long pin mounting method, rods, hinges, or other attachment means to secure the cards thereon. The display device usually has a single array of display cards, or one row of pallet cards to a side, although in some instances, multi-tiered arrays of small cards are used.

Typically all pallet cards in an array on the display device are approximately the same size and shape, with card sizes commonly ranging from as small as 16"×16" on small displays to as large as 24"×48" on large displays. Usually the long dimension forms the spine of the pallet card, which is pivotally mounted to the support device. While some current displays are adjustable to allow use of card arrays of various sizes all known systems use only one size card, both in height and width, on any one array of the display.

It has been found that currently known display devices limit the ability to display material or information on underlying cards of an array, since overlying cards of the array, typically being of about the same size and shape as the underlying cards, cover substantially all of the surface area of the underlying cards. Although a viewer typically can pivot the overlying cards out of the way to view an underlying card, many viewers will not always put forth the time and effort to flip through an entire array to view the material on every one of the cards. Moreover, many "impulse" buyers will not even bother to approach a display if material they might be interested in is hidden from view by overlying cards bearing material that they are not interested in.

Thus, it can be seen that needs exist for improved display devices and methods of display.

SUMMARY OF THE INVENTION

The present invention includes display devices and methods providing improved display characteristics, greater ability to convey information to customers, and being more user-friendly than previously known display systems. The display device and method of the present invention assist both the customer and the dealer by making it easier to organize and understand various product features. For example, product features such as price points can be indicated and related to the consumer and/or the dealer by a corresponding display feature such as the size and/or shape of the display panel or board on which the product is mounted. The display device and method of the present invention also provide improved visual impact and permit easier product comparison, allowing multiple types or styles of product to be viewed simultaneously. Additionally, the dealer can more readily "trade up" when selling to a customer due to the ability to display larger-sized samples of more expensive product, and to explain and show multiple price points for product based on a relation between pricing and display panel size. The display device and method of the present invention also enable a more focused impact display, wherein multiple samples of variations of the same type of material, for example samples of the same carpet pattern in a spectrum of different colors, are displayed on panels of the same display device.

In one aspect, the invention is a display device. The device of the present invention preferably includes a rack; a first display panel mounted to the rack; and a second display panel overlying a portion of the first display panel, whereby at least a portion of the first display panel extends beyond an edge of the second display panel.

In another aspect, the invention is a set of display panels for use in a display device. The set of display panels of the present invention preferably includes at least two display panels, wherein a second display panel of the set can overlie a portion of a first display panel of the set while leaving another portion of the first display panel uncovered.

In still another aspect, the invention is a display method. The display method of the present invention preferably includes the steps of providing a first display panel having a first display surface; and providing a second display panel having a second display surface, the second display panel overlying the first display panel but leaving a portion of the first display surface visible.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

BRIEF DESCRIPTION OF THE DRAWING FIGURES

Figure 3A:
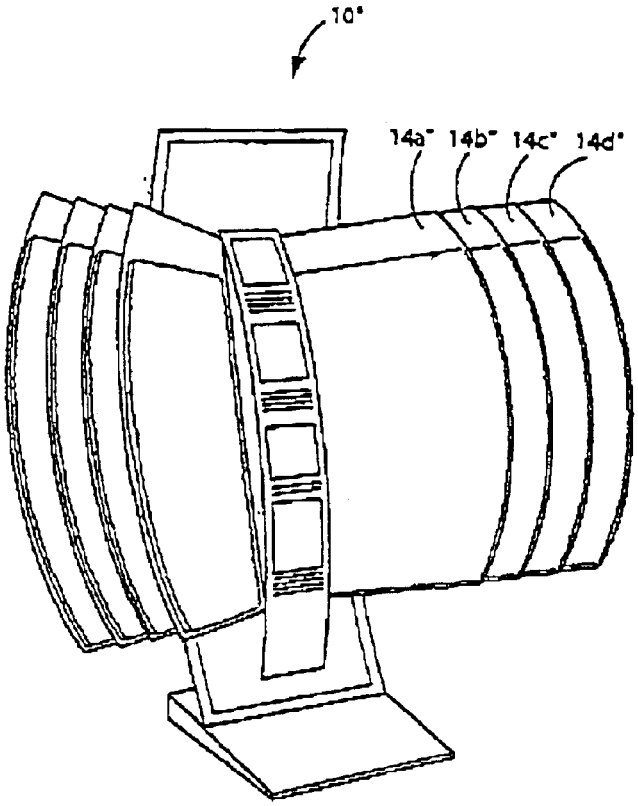
Figure 3B:
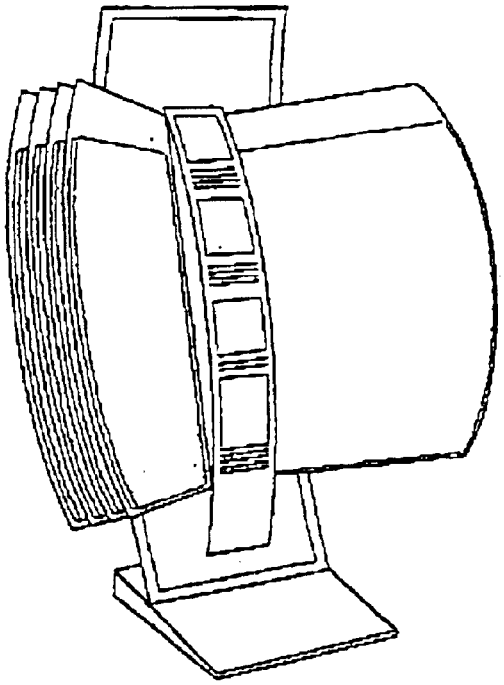

FIGS. 3*a* and 3*b* show perspective views of display devices according still further preferred forms of the present invention.

Figure 4:
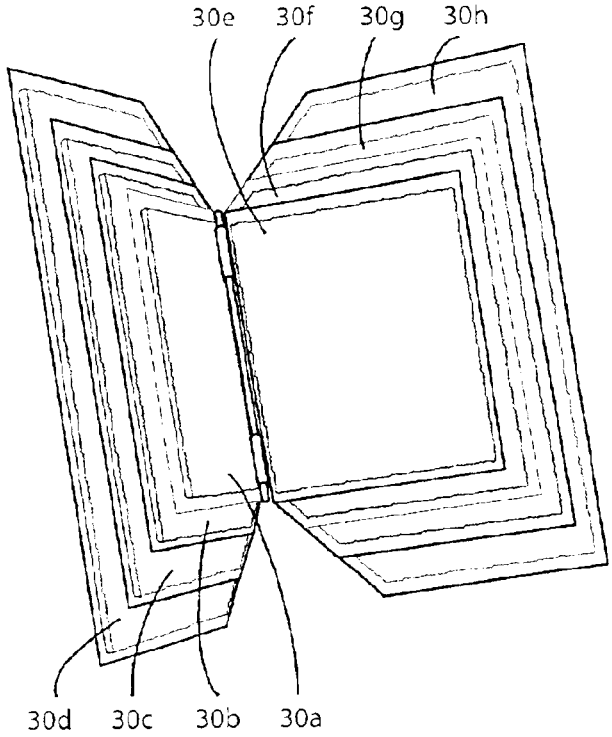

FIG. 4 shows a set of display panels according to another preferred form of the present invention.

Figure 5:
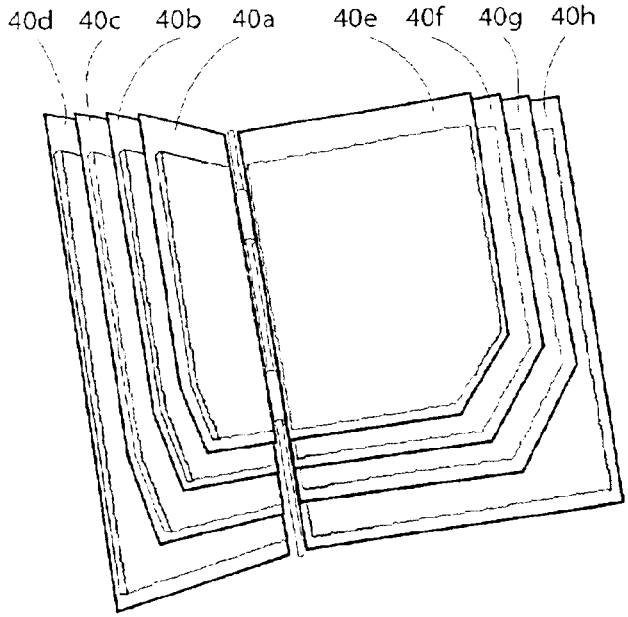

FIG. 5 shows a set of display panels according to still another preferred form of the present invention.

DETAILED DESCRIPTION

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Also, as used in the specification including the appended claims, the singular forms "a," "an," and "the" include the plural unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

In preferred form, the present invention is a display device including two or more pallet cards of varying size and/or shape. The cards are preferably arranged in one or more groups or arrays on a display rack or other support device. In this manner, at least a portion of the material and/or information present on all cards in an array on the display device is visible to a viewer without the need for flipping through the array of cards. If the viewer wishes to see the entirety of an underlying card, he or she can more easily locate the card of interest from its visible portion, and immediately flip the overlying card(s) out of the way of the card of interest.

In example embodiments, the display device of the present invention preferably includes at least one set of two or more pallet cards of varying size, such as for example, pallet cards differing in height, width and/or shape; each set preferably arranged in one or more arrays of cards, for example, from smaller to larger, presented a center out format, a left to right format, a right to left format and/or combinations thereof. In other example embodiments of the invention, pallet cards of the same height are displayed in one or more arrays with varying widths from narrow to wide presented in, for example, a center out format, left to right format, right to left format, and/or any combination thereof. In still other embodiments, the display device of the present invention comprises one or more vertical arrays of cards having the same or different widths, arrayed with longer cards behind shorter cards and/or one or more arrays of cards arranged diagonally, offset at some angle from the horizontal or the vertical, or in a curved or irregular array. In other embodiments, cards of approximately the same height and/or width, but having differing shapes, are arranged to leave at least a portion of an underlying card visible beneath an overlying card.

Figure 1:
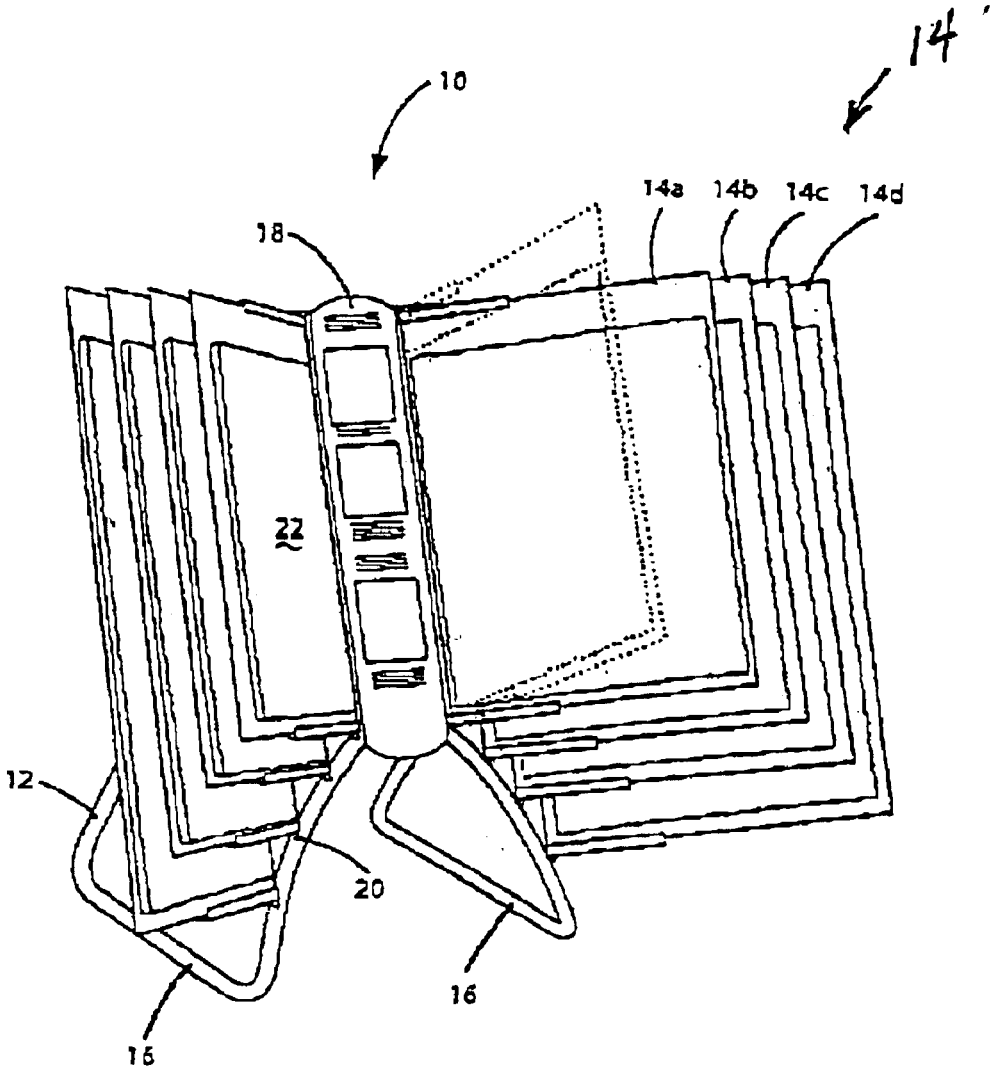
FIG. 1 shows a perspective view of a display device according to one preferred form of the present invention.

As seen best with reference to FIG. 1, the display device 10 of the present invention comprises a rack 12, and one or more arrays or sets (two are shown) of at least two display panels 14 mounted to the rack. The rack 12 preferably comprises one or more support members such as legs or base elements 16 for supporting the display device on a floor, wall or other support surface, and one or more body portions extending from the base elements. The rack 12 also optionally comprises one or more fixed display surfaces 18 for application of material, information, marketing literature, and/or decorative effects. At least one of the display panels 14 is preferably pivotally connected to the rack 12 by one or more pivotal couplings 20, such as hinges, pin couplings, bearings, and/or other attachment means. The panel(s) 14 can be pivotally connected directly to the rack 12, or pivotally connected indirectly to the rack as by connection to another panel that is itself directly or indirectly connected to the rack. Alternatively, the rack 12 may be omitted, and the display panels pivotally connected to one another. Overlying panel(s) 14 are preferably pivotally connected to the rack 12 or to an underlying panel 14, so that the overlying panel(s) can be pivoted (as for example, in the manner of turning a page of a book) out of the way to allow the observer to view the entirety of the underlying panel. For example, panel 14*a* is shown in solid lines depicting a first or "open" position overlying a portion of panel 14*b*, and in broken lines depicting a second or closed position permitting the entirely of panel 14*b* to be viewed by an observer facing the front of the device 10.

In a particularly preferred embodiment of the invention, the rack 12 has a first set or array of two or more display panels pivotally mounted to a first side thereof, and a second array of two or more display panels pivotally mounted to a second side thereof. For example, the depicted embodiment comprises two arrays of panels, each array comprising four display panels 14*a*, 14*b*, 14*c* and 14*d*, one array being arranged on a first side of the rack 12, and the other array on a second side of the rack.

At least one of the display panels overlies at least a portion of another display panel, and preferably has at least one dimension that is smaller than a corresponding dimension of the underlying display panel. In preferred form, the entirety of the overlying display panel overlies the underlying panel. Alternatively, only a portion of the overlying panel overlies the underlying panel, resulting in a partially offset or overlapping array configuration. For example, in the embodiment of FIG. 1, display panel 14*a* overlies display panel 14*b*, and display panel 14*a* has a height and a width less than the height and width, respectively, of display panel 14*b*. Successive underlying display panels 14 preferably each have at least one dimension that is larger than an overlying panel 14, and/or have at least a portion extending beyond an edge of an overlying panel, whereby a portion of each panel is visible to an observer, even when underlying panels are partially covered by an overlying panel. Preferably, if a plurality of panels 14 are provided, their sizes are proportionally stepped in increments from smaller to larger. For example, in the depicted embodiment, panel 14*d* is longer and wider than panel 14*c*, panel 14*c* is longer and wider than panel 14*b*, and panel 14*b* is longer and wider than panel 14*a*. In preferred forms, each panel is larger or smaller than an adjacent panel by an equal increment, or by progressively increasing or decreasing increments.

Figure 2:
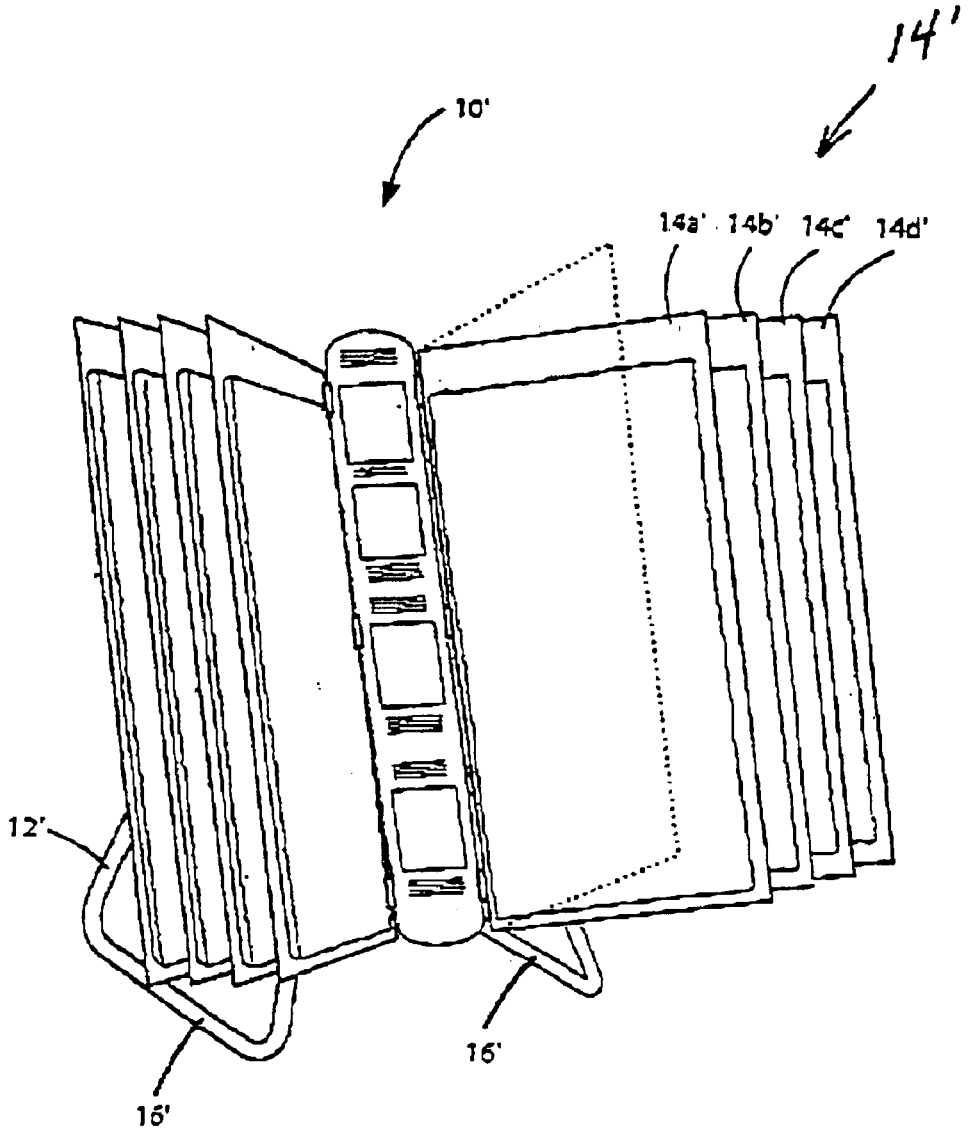
FIG. 2 shows a perspective view of a display device according to another preferred form of the present invention.

FIG. 2 shows another embodiment of a display device 10' according to the present invention, wherein one or more arrays (two are depicted) of panels 14' are pivotally connected to a rack 12' by one or more couplings 20'. Successive underlying display panels 14*a*', 14*b*', 14*c*' and 14*d*' of about the same height preferably have incrementally larger widths than their immediately overlying panel. Of course, it will be understood that the invention also comprehends an array of two or more display panels of about the same width, and with underlying panels having incrementally larger heights than their immediately overlying panel.

Although the depicted embodiments show rectangular display panels, the invention also includes cooperating sets or arrays of display panels with other than rectangular shapes, such as for example, an array of two or more triangular, rectangular, circular, oval and/or otherwise shaped display panels wherein one panel has at least one dimension larger than a corresponding dimension of another panel. The two or more differently-sized display panels of an array can all have the same or similar shapes, or alternatively the array can comprise two or more display panels each having a different shape, wherein at least a portion of an underlying panel extends beyond an adjacent overlying panel. For example, a circular panel of diameter d can overlie a square panel having a side width of d or greater, whereby at least the corners of the underlying square panel extend beyond the overlying round panel and are thereby observable by a viewer. In still other embodiments, overlying panels define one or more openings through which portions of underlying panels are visible. Differently shaped panels of a set can be approximately the same size, or alternatively can also differ in size. Likewise, differently sized panels of a set can have the same shape or different shapes. For example, FIGS. 3*a* and 3*b* show embodiments of the display device 10" of the present invention having radiused edges on their unattached or free sides. The embodiment of FIG. 3*a* includes panels 14*a*", 14*b*", 14*c*" and 14*d*" wherein each successive underlying panel is progressively wider than its next adjacent overlying panel. The display device of FIG. 3*b*, by contrast, includes panels of generally the same size and shape.

FIGS. 4 and 5, for example, depict representative sets of display panels 30*a*, 30*b*, 30*c* and 30*d*, and 30*e*, 30*f*, 30*g* and 30*h* (FIG. 3), and 40*a*, 40*b*, 40*c* and 40*d*, and 40*e*, 40*f*, 40*g* and 40*h* (FIG. 4). The embodiment of FIG. 3 includes panels of different shapes, namely rectangular panels 30*a*, 30*e*, and non-rectangular panels 30*b*, 30*c*, 30*d*, 30*f*, 30*g* and 30*h* having upper and lower corner sections of their attached sides removed. Each successive underlying panel of the embodiment of FIG. 3 extends beyond an overlying panel on all three unattached sides, producing a center-out, framed appearance. The overlying panels of the FIG. 4 embodiment are generally rectangular with one corner of their unattached sides removed, and the base panels 40*d*, 40*h* are rectangular. Each successive underlying panel is longer and wider than its overlying panel, and the tops of all panels in each set are aligned.

Each display panel 14 preferably comprises at least one display surface for displaying information or material 22 such as carpet, wood flooring, laminate, vinyl, ceramic, rugs, and other floor covering products, wallpaper, paneling, paint, wrapping paper, fabric, paper, posterboard, roofing material, other coatings, objects or materials, and/or associated marketing information, pricing, etc. Optionally, each display panel 14 may display more than one material. For example, a single display panel optionally displays a sample of carpet and one or more samples of paint in a coordinated color scheme. In another optional alternate embodiment of the invention, adjacent display panels in a set display different materials (e.g., carpet, wallpaper, roofing, paint and trim color, etc.) in a coordinated color scheme. Preferably, each display panel 14 comprises two display surfaces, one display surface on each side of the panel 14.

The invention also comprises a method of displaying material or information. A first piece of material or information is displayed on a first panel, and a second piece of material or information is displayed on a second panel. The second panel is coupled to the first panel whereby the second panel overlies at least a portion of the first panel. At least a portion of the first panel extends beyond an adjacent edge of the second panel, so that an observer can simultaneously view at least a portion of the material or information displayed on each display panel without moving the second panel. The second panel preferably can be moved (for example, by way of a hinge or other pivotal coupling) to allow the observer to view the entirety of the first panel. In similar fashion, the invention can be extended to a method of displaying material on one or more arrays of three, four or more display panels, whereby each successive underlying display panel preferably has at least one dimension that is larger than an overlying panel, such that a portion of each panel is visible to an observer, even when underlying panels are partially covered by an overlying panel.

While the invention has been described with reference to preferred and example embodiments, it will be understood by those skilled in the art that a number of modifications, additions and deletions are within the scope of the invention, as defined by the following claims.

What is claimed is:

1. A display device comprising:

a rack comprising at least one support member having a body portion extending therefrom; and a first array of at least two display panels pivotally mounted to a first side of said rack, one of said at least two display panels of the first array comprising an underlying display panel having a first display surface with a sample of a first display floor covering material mounted thereon, the first display surface having a first width and a first height, another of said at least two display panels of the first array comprising an overlying display panel having a second width and a second height and having an inner edge pivotally mounted to the rack and a free edge distal the inner edge, at least one of the second width and a second height being sufficiently less than a corresponding one of the first width and the first height such that at least a portion of said first displayed floor covering material is visible beyond the free edge of the overlying panel with the overlying display panel overlying the underlying display panel.

2. The display device of claim 1, further comprising a second array of at least two display panels pivotally mounted to a first side of said rack, one of said at least two display panels of the second array comprising a second underlying display panel having a second display surface with a sample of a second displayed floor covering material mounted thereon, the second display surface having a third width and a third height, another of said at least two display panels of the second array comprising a second overlying display panel having a fourth width and a fourth height and having an inner edge pivotally mounted to the rack, at least one of the fourth width and the fourth height being sufficiently less than a corresponding one of the third width and the third height such that at least a portion of said first displayed floor covering material is visible with the second overlying display panel overlying the second underlying display panel.

* * * * *

UNITED STATES PATENT AND TRADEMARK OFFICE

CERTIFICATE OF CORRECTION

PATENT NO. : 6,811,046 B2
DATED : November 2, 2004
INVENTOR(S) : Stein, Allen

It is certified that error appears in the above-identified patent and that said Letters Patent is hereby corrected as shown below:

Title page,
Item [76], Inventors, "6126" should read -- 6125 --.

Signed and Sealed this

Tenth Day of January, 2006

JON W. DUDAS
*Director of the United States Patent and Trademark Office*